US008667827B2

(12) United States Patent
Lehane, Jr. et al.

(10) Patent No.: US 8,667,827 B2
(45) Date of Patent: Mar. 11, 2014

(54) GRID RUNNER

(71) Applicant: USG Interiors, LLC, Chicago, IL (US)

(72) Inventors: James J. Lehane, Jr., McHenry, IL (US); Peder J. Gulbrandsen, Aurora, IL (US); John L. Hammond, Fairview Park, OH (US); Abraham M. Underkofler, Waukegan, IL (US); Mark R. Paulsen, Beach Park, IL (US)

(73) Assignee: USG Interiors, LLC, Chicago, IL (US)

( * ) Notice: Subject to any disclaimer, the term of this patent is extended or adjusted under 35 U.S.C. 154(b) by 2 days.

(21) Appl. No.: 13/727,820

(22) Filed: Dec. 27, 2012

(65) Prior Publication Data

US 2013/0111963 A1 May 9, 2013

Related U.S. Application Data

(62) Division of application No. 12/848,267, filed on Aug. 2, 2010, now Pat. No. 8,359,801.

(51) Int. Cl.
*B21D 5/14* (2006.01)

(52) U.S. Cl.
USPC ..... 72/179; 29/897.35

(58) Field of Classification Search
USPC ..... 52/506.07, 506.06, 220.6, 631, 837, 52/842, 846; 29/897.35, 897.32, 897.34, 29/505; 248/342, 343, 344; 72/177, 178, 72/179, 180, 181, 182
See application file for complete search history.

(56) References Cited

U.S. PATENT DOCUMENTS

| | | | | |
|---|---|---|---|---|
| 2,213,842 | A | 7/1938 | Cox | |
| 2,986,193 | A * | 5/1961 | Howell | 52/745.05 |
| 3,241,280 | A | 3/1966 | Kreuzer | |
| 3,623,203 | A | 11/1971 | Henshaw et al. | |
| 4,238,550 | A * | 12/1980 | Burgess et al. | 428/586 |
| 4,535,580 | A | 8/1985 | Shirey | |
| 4,542,615 | A | 9/1985 | McCall | |
| 4,569,175 | A | 2/1986 | Abciuk | |
| 4,725,463 | A | 2/1988 | Baumber et al. | |
| 4,794,745 | A | 1/1989 | Platt | |
| 4,848,054 | A | 7/1989 | Blitzer et al. | |
| 4,989,387 | A | 2/1991 | Vukmanic et al. | |

(Continued)

FOREIGN PATENT DOCUMENTS

| | | |
|---|---|---|
| AU | 42268/78 A | 6/1979 |
| EP | 0538915 A1 | 4/1993 |

(Continued)

OTHER PUBLICATIONS

International Search Report and the Written Opinion of the International Searching Authority dated Oct. 5, 2011 for corresponding Application No. PCT/US2011/044941, filed Jul. 22, 2011.

*Primary Examiner* — Robert Canfield
*Assistant Examiner* — Matthew Gitlin
(74) *Attorney, Agent, or Firm* — Pearne & Gordon LLP

(57) ABSTRACT

A roll-formed grid runner comprising a sheet metal strip folded into an upper hollow single wall reinforcing bulb, a double wall web below the bulb, a channel extending laterally from both sides of a lower end of the web to a bend and upwardly from the bend to a panel supporting elevation, the bend on each side of the web existing at a longitudinally extending score line where a thickness of the strip is locally reduced.

3 Claims, 5 Drawing Sheets

(56) References Cited

U.S. PATENT DOCUMENTS

| | | | | |
|---|---|---|---|---|
| 5,154,031 | A | 10/1992 | Wall | |
| 5,279,033 | A | 1/1994 | Platt et al. | |
| 5,577,313 | A | 11/1996 | Guido et al. | |
| 5,761,869 | A | 6/1998 | Tinen et al. | |
| 5,845,447 | A | 12/1998 | Bodine et al. | |
| 5,896,724 | A | 4/1999 | Tofts | |
| 5,930,966 | A | 8/1999 | Wood et al. | |
| 5,979,055 | A | 11/1999 | Sauer et al. | |
| 6,000,190 | A | 12/1999 | Richardson | |
| 6,047,511 | A | 4/2000 | Lehane et al. | |
| 6,260,325 | B1 | 7/2001 | Wendt et al. | |
| 6,318,047 | B1 | 11/2001 | Richardson | |
| 6,332,301 | B1 | 12/2001 | Goldzak | |
| 6,341,467 | B1 | 1/2002 | Wycech | |
| 6,446,407 | B1 | 9/2002 | Lehane et al. | |
| 6,745,536 | B2 | 6/2004 | Tallman et al. | |
| 6,928,847 | B2 * | 8/2005 | Akutsu et al. | 72/180 |
| 6,964,140 | B2 | 11/2005 | Walker et al. | |
| 7,516,585 | B2 | 4/2009 | Lehane, Jr. et al. | |
| 7,655,862 | B2 | 2/2010 | Caveney et al. | |
| D618,826 | S | 6/2010 | Lehane, Jr. | |
| 8,056,294 | B2 | 11/2011 | LaLonde | |
| 8,084,117 | B2 | 12/2011 | Lalvani | |
| 2006/0207212 | A1 | 9/2006 | Durney | |
| 2008/0245018 | A1 | 10/2008 | Miller et al. | |
| 2009/0205387 | A1 * | 8/2009 | Durney et al. | 72/178 |
| 2010/0107529 | A1 | 5/2010 | Engelmeyer | |
| 2010/0135720 | A1 * | 6/2010 | Toben et al. | 403/353 |
| 2010/0139189 | A1 | 6/2010 | LaLonde | |
| 2011/0247297 | A1 | 10/2011 | Bae et al. | |
| 2013/0062003 | A1 * | 3/2013 | Shulkin et al. | 156/196 |

FOREIGN PATENT DOCUMENTS

| | | | |
|---|---|---|---|
| EP | 1978175 | A2 | 10/2008 |
| GB | 2182078 | A | 5/1987 |
| GB | 2182079 | A | 5/1987 |
| GB | 2197810 | A * | 6/1988 |

* cited by examiner

GRID RUNNER

BACKGROUND OF THE INVENTION

The invention relates to suspended ceiling grid runners and, in particular, roll-formed sheet metal grid runners of novel cross-section.

PRIOR ART

Various grid runner profiles, in addition to the generic inverted tee profile, have been proposed to achieve a variety of ceiling visual effects, appearance, and functions. One such grid runner, disclosed in U.S. Pat. No. 4,794,745, has a box-like section centered below opposed panel supporting flange elements. The manufacture of this prior art profile from a single strip can entail expensive roll set tooling and the resulting product is asymmetric about a vertical center line. This prior art single strip construction, from a practical standpoint, may require its entire body to be painted, including its unseen parts which, typically, comprise the majority of the painted side of the unitary strip. Moreover, the roll-forming equipment to produce this prior art shape can be difficult to maintain to achieve consistent results.

SUMMARY OF THE INVENTION

The invention provides a distinctive grid runner profile with a central channel structure below opposing panel supporting flange elements. The disclosed profile can be wholly symmetrical and can be manufactured with relatively simple tooling. The invention departs from conventional roll-forming techniques by shaping the profile without a back-up roll on the inside corners of the channel structure depending below the panel supporting flange elements.

In the disclosed preferred embodiment, the depending channel and flange elements are capped with a face sheet or strip in a conventional manner. Only this face strip need be painted since it is the only part of the novel grid tee visible after installation of the ceiling panels.

DESCRIPTION OF THE PREFERRED EMBODIMENT

Figure 1:
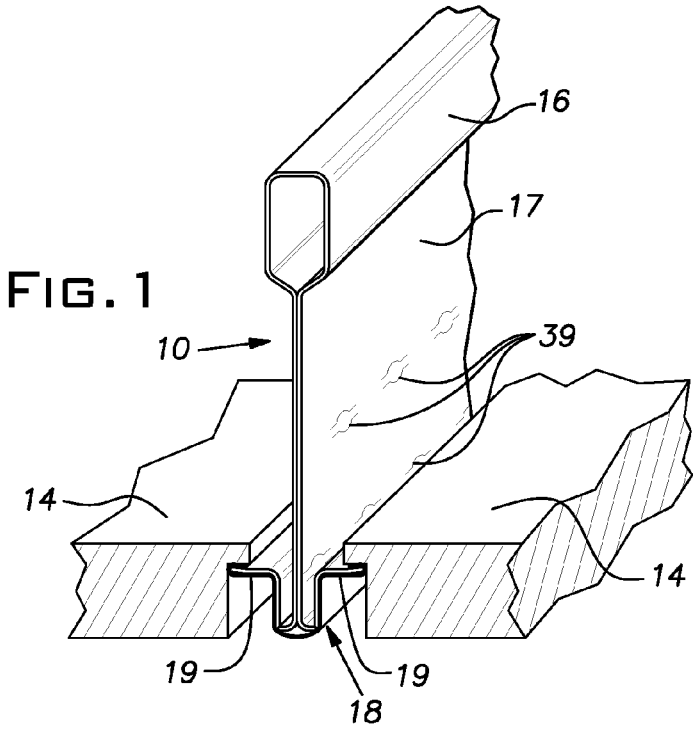
FIG. 1 is an isometric fragmentary view of a grid runner embodying the invention shown in relation to typical rabbeted ceiling panels.
Figure 2:
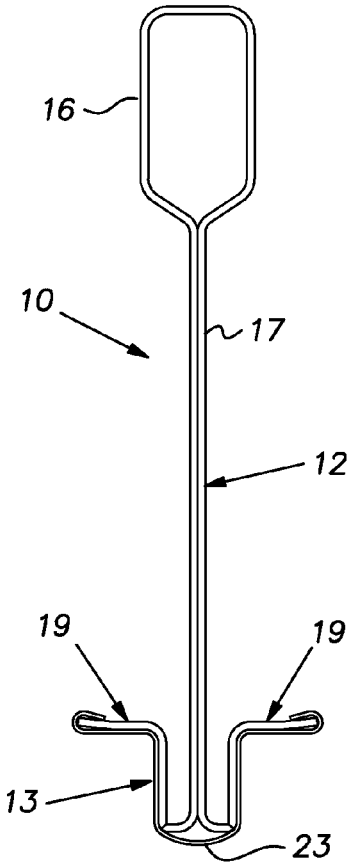
FIG. 2 is a cross-sectional view of the grid runner of the invention.

Referring now to the drawings and in particular to FIGS. 1 and 2, there is shown a short length of an elongated grid runner or tee 10 made in accordance with the invention. The tee 10 is used to construct a rectangular grid for a suspended ceiling in a generally conventional manner. The tee 10 can be used for main tees and cross tees as is known in the art. Conventional end connector elements, integrally stamped or attached clips, are provided on the ends of the tee 10 and holes for suspension wires and slots for cross tee end connectors are stamped along the body of the tee in the manufacturing process referenced below. The tee 10 is comprised of two separate sheet metal strips 12, 13 roll-formed into the cross-sectional shape shown in FIGS. 1 and 2. A rectangular grid made up of multiple main and cross tees 10 can support conventional rectangular ceiling panels or tiles 14 which, in the illustrated example of FIG. 1, are rabbetted at their edges so that the visible parts of the tees are recessed into the plane of the tiles.

The cross-section of the tee 10 comprises an upper hollow generally rectangular reinforcing or stiffening bulb 16, a vertical web 17 depending from the bulb, a lower U-shaped channel 18 bisected by the web, and oppositely extending horizontal panel supporting flanges 19 at the upper edges of the channel.

Preferably, the elements of the tee cross-section are symmetrical about a central vertical plane. Describing the tee 10 in greater detail, a main body strip 12 is folded by a roll-forming process discussed below into the upper reinforcing bulb 16, which has single layer walls. The main body strip 12 is folded so that it converges at the center plane of the tee 10 to form the web 17 as a double layer. At the bottom of the web 17, parts of the main body strip 12 are folded so that they diverge generally horizontally to form an inner layer of a bottom 23 of the channel 18. At regions spaced from the web 17, the major body strip 12 is folded or bent generally vertically upwardly to form inner layer parts of sides 22 of the channel 18. At the upper region of the channel 18, the main body strip 12 is folded horizontally outwardly to form upper layers of the flanges 19.

The bottom 23 and sides 22 of the channel 18 and the flanges 19 are covered by the face strip 13. The face strip 13 is locked on the main body strip 12 by hems 24 made by folding marginal areas of the face strip around longitudinal edges 26 of the major or main body strip 12 at the distal edges of the flanges 19. When ceiling panels 14 are installed on a grid of the tees 10, only the face or cap strip 13 is visible so that it is unnecessary to paint the main body sheet. The face sheet or strip 13 is painted or otherwise provided with a desired decorative coating or finish. Typically, the main body strip 12 and the face strip 13 are formed of steel but other metals may be used for one or both strips. By way of example, the main body sheet can be hot dipped galvanized 0.016" gauge steel for main tees and 0.014" for cross tees. The face sheet 13 can be a lighter gauge of, for example, 0.0085".

The proximity of the vertical sides 22 of the channel 18 to the web 17 and the presence of the reinforcing bulb 16, which overlies the space between the web and the channel sides, makes conventional techniques impractical for roll-forming the cross-sectional shape of the tee 10. There is insufficient room for forming rolls of adequate strength to back-up the metal stock on the side of the main body strip 12 when forming the corner between the bottom 23 of the channel 18 and each of its sides 22. The problem of insufficient clearance is made worse by the presence of connectors at the ends of the tees 10. The invention overcomes this problem by eliminating the need for back-up rolls in this area. The inventive process involves pre-conditioning the main body strip 12 in areas that ultimately become the sites of the channel corners. This pre-conditioning step is accomplished by weakening the main body strip 12 by scoring it along longitudinal lines located where the channel corners are desired in the finished product. The following disclosure presents a preferred manner of practicing the inventive process.

A grid tee preform 31 (FIG. 5M) is made in a primary roll set depicted in FIGS. 5A-5M. Grid tee stock exiting the primary roll set is rough cut to length and positioned in a press to cut it to a precise length, form suspension wire holes and cross tee slots in it, and to stamp an integral end connector forms or attach separate end connectors, as is customary in the industry. After the stamping operations are performed, the tee preform 31 is passed to a secondary roll set depicted in FIGS. 6A-6L to finish form it.

Figure 3:
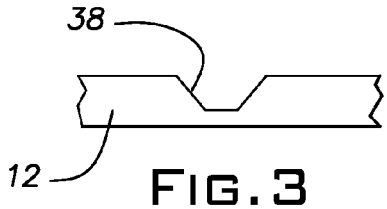
FIG. 3 is a fragmentary cross-sectional view, on a greatly enlarged scale, of a sheet metal strip to be rolled into the main body of the grid runner of FIGS. 1 and 2 showing a score line employed with the invention.

In FIGS. 5A-5M and FIGS. 6A-6L, only a portion of each roll station is shown, it being understood that each roll at a station is symmetrical about a center plane of the tee. Describing the operation of the primary roll set (FIGS. 5A-5M) in greater detail, a flat main body strip 12, which typically is fed from a coil, passes between rollers at a first station shown in FIG. 5A. Carbide roller sections 36 near the outer ends of a top roll unit each have a small circumferential rib located on a circumferential line indicated at 37 that stands radially off surrounding circumferential areas of the roller by, for example, 0.008". The rib 37 located in the center of the axial length of the carbide roller section 36 has essentially the same profile as a groove or score 38 shown in FIG. 3 that it permanently forms in the main body sheet 12. The score 38 can be about 0.006" to about 0.008" deep, by way of example. The portion of the main body sheet shown in FIG. 3 is on a greatly enlarged scale. While as mentioned, only a portion of each roll station is shown, a rib 37 exists on a carbide roller section 36 adjacent both lateral margins or edges of the main body strip 12 so that two parallel longitudinally extending score lines 38 are formed in these marginal areas of the strip.

Figure 4:
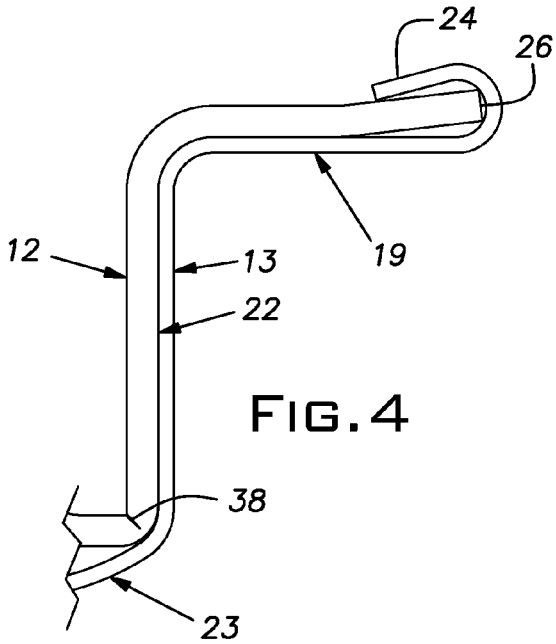
FIG. 4 is a fragmentary cross-sectional view, on an enlarged scale, of a fold area, made at the score line of FIG. 3, of the grid runner of FIGS. 1 and 2.
Figure 5A:
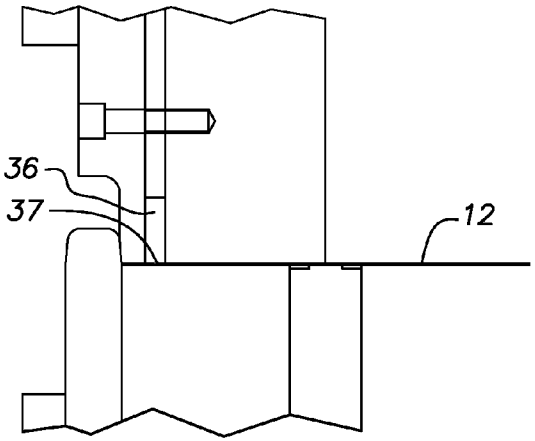
FIGS. 5A-5M are diagrammatic representations of successive rolls of a primary roll set for producing the grid runner of the invention.
Figure 5B:
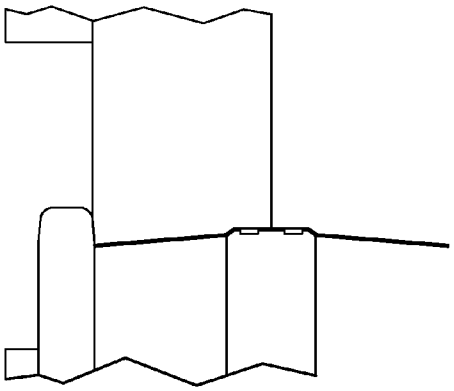
Figure 5C:
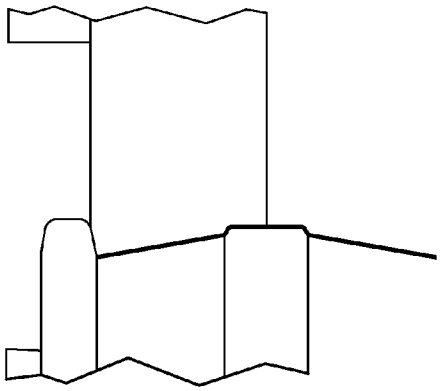
Figure 5D:
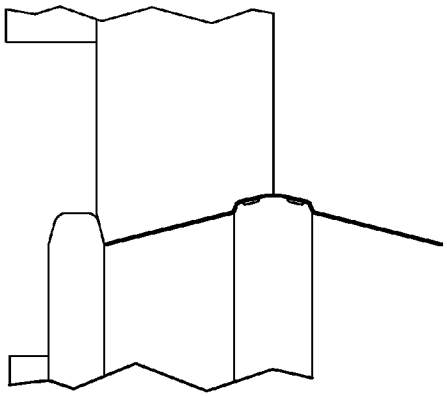
Figure 5E:
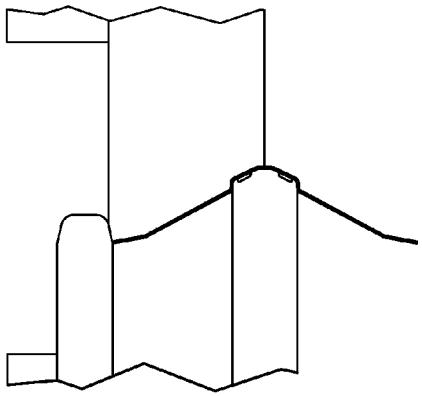
Figure 5F:
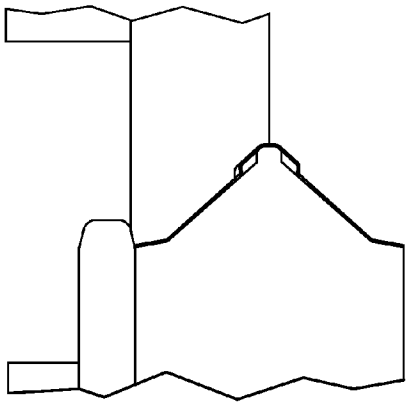
Figure 5I:
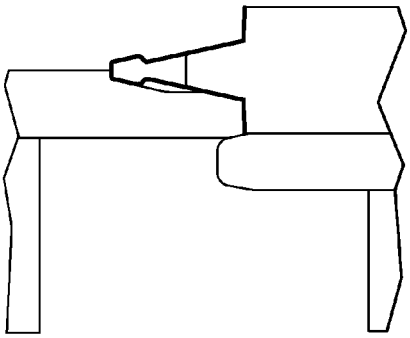
Figure 5H:
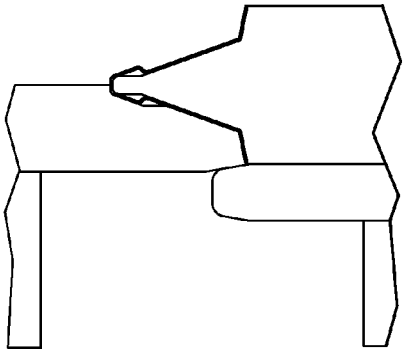
Figure 5G:
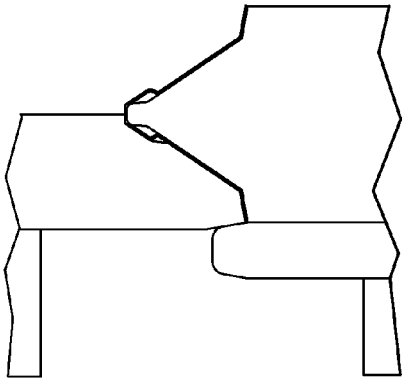
Figure 5M:
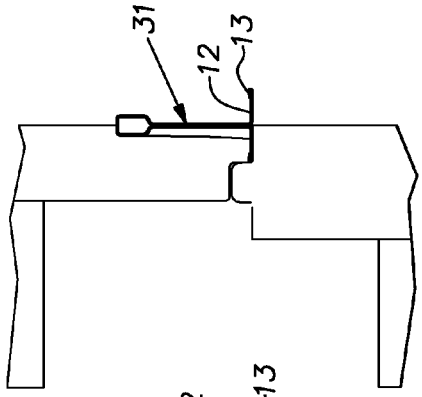
Figure 5L:
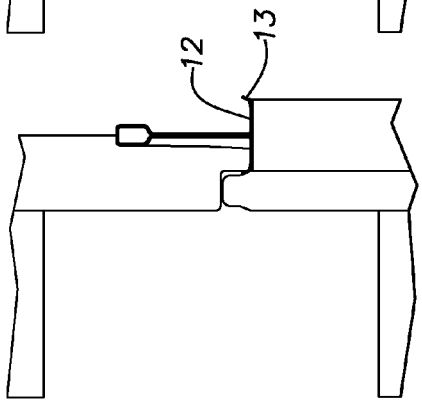
Figure 5K:
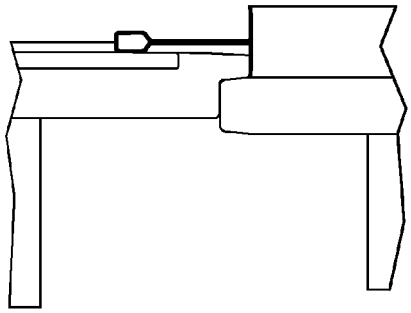
Figure 5J:
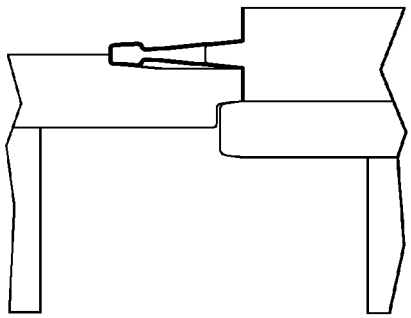
Figure 6A:
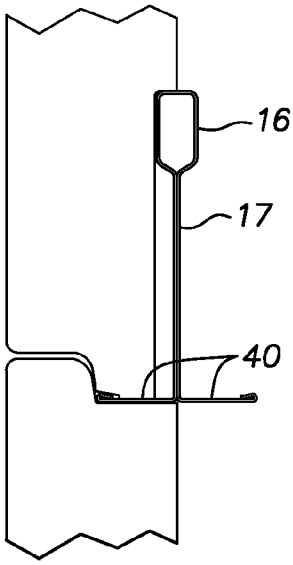
FIGS. 6A-6L are diagrammatic representations of successive rolls of a secondary roll set for producing the grid runner of the invention.
Figure 6B:
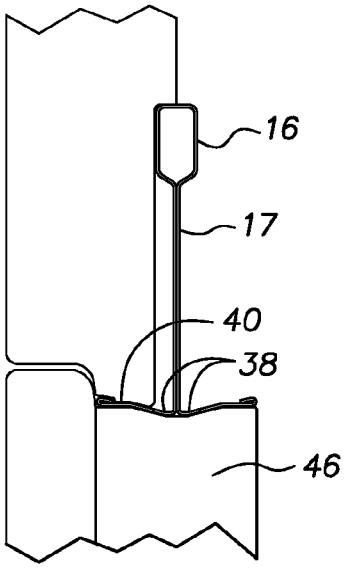
Figure 6C:
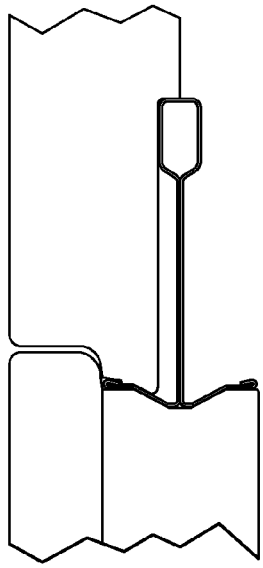
Figure 6D:
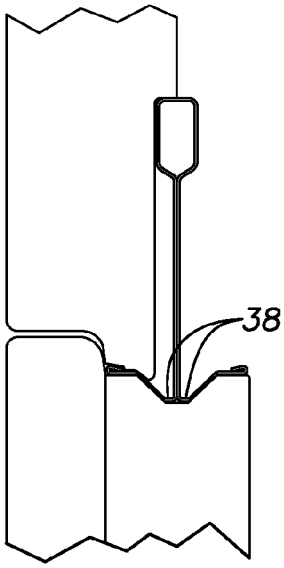
Figure 6E:
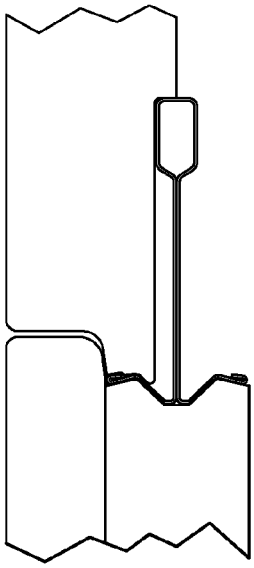
Figure 6F:
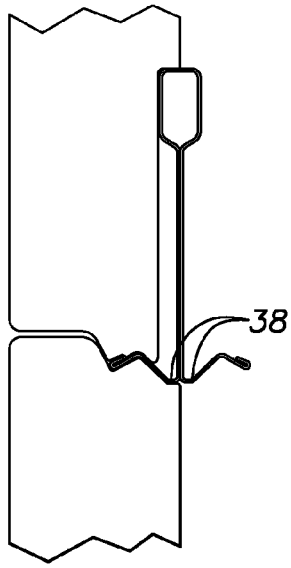
Figure 6G:
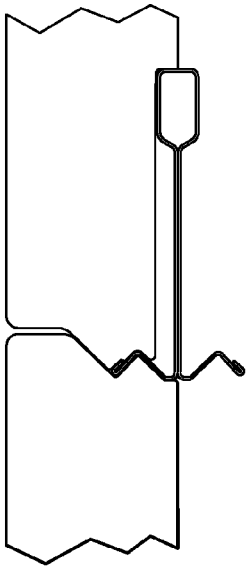
Figure 6H:
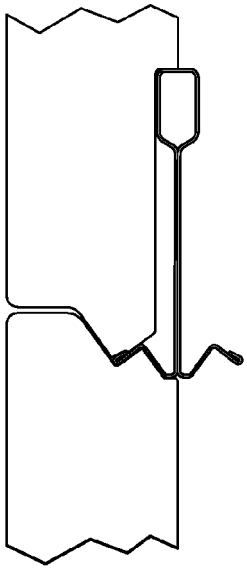
Figure 6I:
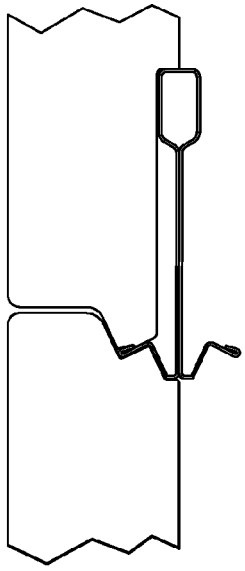
Figure 6J:
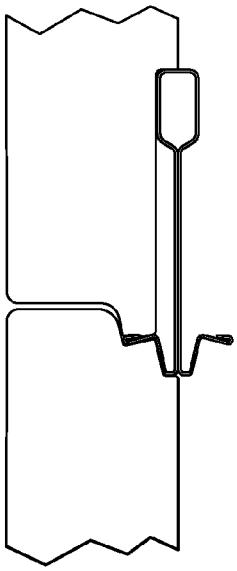
Figure 6K:
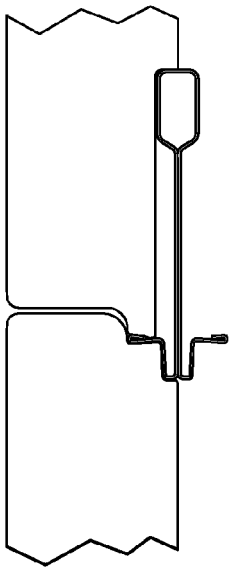
Figure 6L:
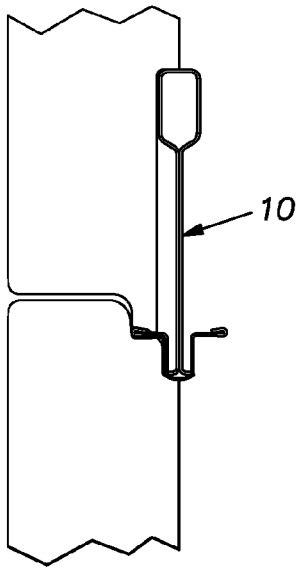

FIGS. 5B-5K diagrammatically show successive roll stations with top and bottom roll sets that progressively roll-form the main body strip 12 into a tee shape in a generally conventional manner although the tee shape is somewhat taller than a standard profile. At the roll station of FIG. 5L, the face strip 13 has been introduced onto the bottom flange areas of the main body strip 12. FIG. 5M illustrates the capture or final assembly of the face strip 13 on the main body strip 12 with the roll set folding marginal areas of the face strip back over longitudinal edges 26 of the main body strip 12 to form the hems 24 (FIGS. 2 and 4).

Preferably, the layers of the web 17 are locked together with stitches 39 before the preform 31 is cut to length and, typically before the last roll station (FIG. 5M) in the primary roll set. This is done, for example, by a known process such as the process disclosed in U.S. Pat. No. 6,047,511 which can be modified by first compressing the material lanced from the web 17 to expand it relative to the lanced hole from which it is cut rather than, as the patent shows, first compressing the material surrounding the lanced hole to shrink the hole relative to the material lanced from the hole. As shown in FIG. 1, two vertically spaced rows of stitches 39 can be formed in the web 17. The stitches 39 improve the stability of the grid tee preform 31 when it is run through the secondary roll set.

As previously mentioned, the perform tee 31, made of the combined main body strip 12 and face strip 13 finished in the primary roll set of FIGS. 5A-5M is rough cut to a length and passed to a stamping press. After the preform tee 31 is processed in the press, it is sent through the secondary roll set schematically shown in FIG. 6A-6L. Each figure progressing from FIG. 6A-6L represents a successive roll set. An inspection of these roll set views shows that there is no upper roller back-up on the upper side of the preform flanges, designated 40 in FIG. 6A, that lies vertically under the bulb 16. Close inspection of the FIGS. 6B-6L reveals that the preform flange 40 bends upwardly on each side of the web 17 at the score line 38 despite the absence in each of these illustrated stations of a back-up roll on the upper side of the flange 40 inward of the score lines 38. This bending is initiated in the roll station shown in FIG. 6B where the flange 40 is deflected upwardly by a lower roll 46. The rolls in the stations shown in FIG. 6B-6K progressively deform each side of the flange 40 through a series of gull wing stages. The station at FIG. 6K squares up the gull wing character of the tee flange departing the station shown in FIG. 6J. The tee 10 is finally shaped in the station of FIG. 6L. Throughout the stations, 6B-6L, the score lines 38, like creases in a sheet of cardboard, localize the bending of the flange 40 even though there is no back-up roll at the inside of this bend.

It should be evident that this disclosure is by way of example and that various changes may be made by adding, modifying or eliminating details without departing from the fair scope of the teaching contained in this disclosure. The invention is therefore not limited to particular details of this disclosure except to the extent that the following claims are necessarily so limited.

What is claimed is:

1. A method of roll-forming a grid runner from a sheet metal strip comprising forming a body with an upper reinforcing bulb, a double layer vertical central web, a channel with portions on each side of the web, the channel on each side of the web including a generally laterally extending part and a generally upright extending part joined at a fold to the laterally extending part, the fold being accomplished by first scoring the metal strip on a line corresponding to the location of the intended fold and then using a set of rolls rotating about parallel axii perpendicular to the web to turn up the upright extending part at roll stations devoid of opposing roll areas at said laterally extending part.

2. A method as set forth in claim 1, including the step of capping the channel with a separate metal strip.

3. A method as set forth in claim 1, wherein the score lines on each side of the web are located closer to each other than a width of the bulb.

* * * * *